US005374510A

United States Patent [19]

Westfal et al.

[11] Patent Number: 5,374,510

[45] Date of Patent: Dec. 20, 1994

[54] SUPPORT MATERIAL FOR LIGHT SENSITIVE MATERIALS WITH BACK ANTICURL LAYER

[75] Inventors: Horst Westfal, Belm; Andreas Diekmann, Hagen, both of Germany

[73] Assignee: Felix Schoeller jr. Papierfabriken, Osnabruck, Germany

[21] Appl. No.: 171,099

[22] Filed: Dec. 21, 1993

[30] Foreign Application Priority Data

Dec. 30, 1992 [DE] Germany ..... 4244529

[51] Int. Cl.[5] ..... G03C 1/85

[52] U.S. Cl. ..... 430/539; 428/411.1; 428/484; 430/523; 430/930

[58] Field of Search ..... 430/930, 539, 523; 428/484, 485, 486, 411.1

[56] References Cited

U.S. PATENT DOCUMENTS

| | | | |
|---|---|---|---|
| 4,396,709 | 8/1983 | Kameoka et al. | 430/539 |
| 4,977,065 | 12/1990 | Westfal et al. . | |
| 5,100,769 | 3/1992 | Wesfal et al. | 430/930 |
| 5,219,718 | 6/1993 | Hatakeyama et al. | 430/539 |
| 5,264,339 | 11/1993 | Tavernier et al. | 430/539 |

FOREIGN PATENT DOCUMENTS

| | | |
|---|---|---|
| 297240 | 4/1988 | European Pat. Off. . |
| 395785 | 5/1989 | European Pat. Off. . |
| 3721808 | 12/1989 | Germany . |
| 59191030A | 1/1993 | Japan . |

OTHER PUBLICATIONS

Japanese Laid Open Publication 59191030 (English translation).

*Primary Examiner*—Jack P. Brammer
*Attorney, Agent, or Firm*—Lockwood, Alex, Fitzgibbon & Cummings

[57] ABSTRACT

A support material for light sensitive materials is disclosed which has an anticurl layer on the back which contains at least a hardening agent and a bone gelatin that has been degraded by enzymatic action, and the gelatin has more than 40% low molecular fractions having a molecular weight of less than 100,000 and a gel strength of 200–250 g Bloom.

17 Claims, No Drawings

SUPPORT MATERIAL FOR LIGHT SENSITIVE MATERIALS WITH BACK ANTICURL LAYER

This invention relates to a support material for light sensitive materials with an anticurl layer on the back.

Gelatin is used with most photographic materials in order to form the silver halide emulsions, the protective layers and the coatings on the back. However, gelatin layers swell when exposed to water and have a low mechanical strength when swollen. Therefore, they are usually hardened with suitable hardening agents which crosslink the gelatin molecules and, thus, cause a reduced water uptake or swellability of the layer, an increase in the melting point and an improvement in the mechanical strength of the gelatin layer. Hardened gelatin layers are resistant especially to photographic treatment baths.

The light sensitive gelatin layers on the front side of the support material are usually opposite gelatin layers on the back of the support material. By using gelatin as the same binder on both sides of the support material, the swelling behavior in the photographic treatment baths and the behavior of the layers in the subsequent drying step should be kept as identical as possible, so the material remains flat during the entire treatment process as well as in subsequent use. Therefore, the layers applied to the back of the base support material are referred to as antiroll layers, anticurl layers or noncurling layers. The thickness of these layers depends on the swelling properties and the thickness of the coating on the front side.

The anticurl layers generally also contain various additives. These additives may include wetting agents such as saponin, matting agents such as silica, plasterciz-ers such as glycerol, organic acids such as citric acid, small amounts of other water soluble high polymer compounds such as polyvinyl alcohol, or antistatics such as sodium nitrate.

The resistance of the anticurl layers with respect to the photographic treatment baths is achieved by hardening the gelatin with so called hardening agents. Known hardening agents for gelatin include chromium-(III) salts, aldehydes, N-methylol compounds, dialdehyde polysaccharides, polyfunctional epoxies, aziridines, polyfunctional vinyl compounds, triacryl formalin, substituted dichloro-s-triazines and other substances described in chapter 2 of the book *The Theory of the Photographic Process* by T. H. James (London, 1977) .

The hardening agents are either added to the gelatin solutions before processing or they are applied as a separate solution to the gelatin layer which is already on a base support material. In the second case, the hardening agents diffuse into the gelatin layer where they react with peptide chains. These two processes can also be combined in such a way that a part of the hardening agent is added to the gelatin solution and the other portion of the hardening agent is subsequently applied to the layer.

All the substances that are conventionally used as hardening agents have preferred areas of application and are not optimal for other applications. In other words, they suffer from one or more disadvantages in those applications. Aliphatic aldehydes and diketones are not suitable for color photographic layers because they can react with the usual dye couplers or other emulsion additives. Polyepoxides, triazines and polysaccharides are very suitable for color photographic layers, but they react very slowly and, therefore, are not suitable for gelatin layers that are subject to mechanical stress shortly after drying the layer. Other hardening agents, such as chromium salts, are so reactive that a gelatin solution mixed with them will show an increase in viscosity during processing. Still other hardening agents are not sufficiently diffusion resistant and they change the hardness condition of neighboring layers during storage.

Thus, all the hardening agents known to date have one disadvantage or another, and do not have the broad range of applicability desired especially for auxiliary gelatin layers that are applied to a base support material before applying the photographic layers and subsequently they are in contact with the actual photographic layers.

German DE 3,721,808 describes a rapid method of hardening gelatin by applying two successive coatings, whereby the second top coating is formed from a hardening agent solution of chromium salts. This patent also describes why the water uptake capacity of anticurl layers should be lower than that of the light sensitive emulsion layers. The water absorption capacity of the hardened anticurl layers is determined in German DE 3,721,808 by gravimetric determination of a test strip after 10 minutes of treatment in distilled water at 22° C. and then drying. The desired water absorption of less then 2.5 g $H_2O$ per 1 g of gelatin is achieved according to the aforementioned patent only through a separately applied hardening agent layer that contains a chromium(III) salt. As a result, the back of the light sensitive emulsion support material always has an unwanted faint green discoloration, depending on the amount and thickness of the anticurl layer. In addition, applying two layers is more expensive and susceptible to problems that are not presented when applying just one layer.

European EP 395,785 achieves the desired low water absorption with a coating that contains gelatin, an aliphatic polyhydric alcohol, an N-methylol compound and a reaction product of triazine and formaldehyde.

The lowest possible water uptake capacity is desired for anticurl layers. A low water uptake capacity means intense hardening of the gelatin layer. At the same time, this yields an improved resistance to mechanical stresses, such as those to which the layers are exposed by the conveyor rollers in automatic developing equipment.

It is therefore of great interest to discover products that will permit better hardening of gelatin with all hardening agents in general.

One special goal is to develop an anticurl layer whose water absorption capacity is further reduced in comparison with the state of the art above described.

Therefore, the present invention has as an object a support material for light sensitive materials with an anticurl layer on the back, where the anticurl layer is insensitive to mechanical stress (scratch resistance) and has a reduced water absorption (water resistance).

Another object of the present invention is to form the anticurl layer in such a way as to yield a product with little or no fogging.

These objects are achieved by a support material for light sensitive materials with an anticurl layer on the back comprising at least a hardening agent and a bone gelatin that has been degraded enzymatically.

Specifically, the gelatin according to the present invention contains more than about 40% low molecular fractions having a molecular weight of less than 100,000 and a Bloom value of about 200–250 g. Such gelatin may be obtained from Gelatinefabrik Koepff & Sohne, Heilbronn, as its "Gelatine ZKN 505".

Triglycidyl isocyanurate in particular is classified as a hardening agent.

Bloom is a measure of gel strength (gel elasticity) and is expressed as the force required to press a stamp with a diameter of 12.7 mm and a flat bottom surface 4.00 mm into a gel of 6.6% dry solids.

This extensively degraded gelatin has a higher concentration of reactive groups and, therefore, permits a higher crosslinking density (hardening). It can be hardened with any hardening agents that are also used for standard gelatin product lines. In all cases, hardening is more intense and thus the properties of scratch resistance and water resistance that are desired for the anticurl properties are also improved.

Of the large number of products available, the preferred hardening agents for anticurl layers include aliphatic aldehydes, di- and triazines, polyepoxy compounds, polyfunctional vinyl compounds and chromium salts.

The amounts of hardening agents is about 0.5–12 wt %, preferably about 1–6 wt %, based on the amount of gelatin.

The anticurl layers may also contain wetting agents such as saponin, plastercizers such as aliphatic polyalcohols, matting agents such as silicic acids or silicas, organic acids such as citric acid, antistatics such as inorganic salts or theological additives such as carboxymethylcellulose.

It has proven advantageous from the standpoint of the hardening intensity, the antistatic properties and the elasticity of the anticurl layer to add an aliphatic polyalcohol in amounts of up to 50 wt %, preferably 5–30 wt %, based on the amount of gelatin. Aliphatic polyalcohols in this sense include ethylene glycol, glycerol and polyglycols with a molecular weight of up to about 2000.

In one embodiment of the present invention, a mixture of gelatin according to this invention and the hardening agent triglycidyl isocyanurate has been found to be especially advantageous.

In another embodiment, the water absorption by the anticurl layer is less than about 1 g/g gelatin, measured after 10 minutes of exposure to distilled water at 22° C.

In order to be able to apply a large enough amount in one operation, and at the same time minimize the increase in viscosity of the gelatin solution mixed with the hardening agent over a period of time, the gelatin according to the present invention should preferably have the following characteristic properties: viscosity of a 10 wt % solution at 40° C.=about 10–20 mPas, and the hardening time of a 10 wt % solution at 35° C.=about 300–400 minutes.

The hardening time is determined with a Tecam solidification timer. 135 g water are added to 15 g of a 10% gelatin solution. This solution is swollen for 30 minutes at room temperature and then melted at 40° C. The pH is adjusted to 6.0 in the Tecam timer at 35° C., 4.2 ml 10% formalin solution are added, and the mixture is stirred for 15 minutes. Then the time required to form a solid gel is measured with the Texam timer.

In the principle, the anticurl layer may be applied to the support material in one or two steps. In the first case, the solution to be applied must already contain all the components. If the coating is applied in two steps, then the first coating solution applied will usually contain a smaller amount of hardening agent(s). However, the amount must be sufficient for this first layer to be able to withstand the mechanical stress of the second coating after drying. This second coating solution generally comprises a dilute solution of hardening agent.

With both variants (single and double layer variants) the desired properties of the anticurl layer can be achieved, including those of the preferred form using triglycidyl isocyanurate. The single layer variant is preferred for economic reasons and from the standpoint of production technology. Drying the applied coating solution from the sol form is also preferred for economic reasons.

The coating solution may be applied with any of the conventional application and metering methods, such as roll coating, gravure coating and nip coating methods, optionally with a subsequent air brushing or roll doctoring.

The anticurl layer that is especially preferred according to the present invention and contains at least the gelatin according to the invention and the hardening agent triglycidyl isocyanurate has another advantageous property with regard to the coating solution to be applied. The coating solution can be processed in a wide pH range from 5 to 9 without any problem with regard to the rheology of the solution or the layer properties achieved. This means that the solution meets various requirements and can accommodate fluctuations in pH during processing.

The following examples are presented to illustrate the present invention in greater detail:

EXAMPLES B1–B3 AND COMPARATIVE EXAMPLES V1–V3

A base support material comprising 175 g/m$^2$ paper and one layer per side of 35 g/m$^2$ polyethylene on each side, where the polyethylene layer on the front side was pigmented with 11.5 wt % titanium dioxide, was coated with the following anticurl layer solutions:

| | Concentration of the aqueous dilution, wt % | Amounts of Ingredients, wt % | | | | | |
|---|---|---|---|---|---|---|---|
| | | Example B1 | Comparative Example V1 | Example B2 | Comparative Example V2 | Example B3 | Comparative Example V3 |
| Gelatin 1* | 20 | — | 50.0 | — | 50.0 | — | 50.0 |
| Gelatin 2* | 30 | 42.5 | — | 42.5 | — | 42.5 | — |
| Sodium nitrate | 25 | 5.4 | 4.25 | 5.4 | 4.25 | 5.4 | 4.25 |
| Silicon dioxide* | | 0.85 | 0.65 | 0.85 | 0.65 | 0.85 | 0.65 |
| Wetting agent* | 10 | 0.8 | 0.8 | 0.8 | 0.8 | 0.8 | 0.8 |
| IPA/BU/$H_2O$* | | 10.8 | 10.0 | 10.0 | 10.0 | 10.0 | 10.0 |
| Citric acid | 10 | 0.2 | 0.2 | — | — | — | — |
| Chrome-alum | 10 | 0.8 | 0.8 | — | — | — | — |
| Glyoxal | 10 | 0.8 | 0.8 | — | — | — | — |
| TAF/FA* | 2.5 | — | — | — | — | 3.0 | 3.0 |
| Formaldehyde | 30 | — | — | 0.25 | 0.25 | — | — |

-continued

| | Concentration of the aqueous dilution, wt % | Amounts of Ingredients, wt % | | | | | |
|---|---|---|---|---|---|---|---|
| | | Example B1 | Comparative Example V1 | Example B2 | Comparative Example V2 | Example B3 | Comparative Example V3 |
| Dimethylol urea | 5 | — | — | — | — | 7.5 | 7.5 |
| Ethylene glycol | | — | — | — | — | 3.5 | 3.5 |
| Glycerol | | 1.0 | 1.0 | — | — | — | — |
| Demineralized water | | 36.85 | 31.50 | 40.20 | 34.05 | 26.45 | 20.3 |
| ph adjusted to | | 6.0 | 6.0 | 5.3 | 5.4 | 6.6 | 6.6 |
| Viscosity, mPas | | | | | | | |
| immediate | | 79 | 79 | 72 | 70 | 72 | 60 |
| after 16 hours | | 83 | 96 | 81 | 96 | 73 | 84 |
| Weight of application (dry), g/m$^2$ | | 4.7 | 4.8 | 2.9 | 3.0 | 3.7 | 3.5 |

*Gelatin 1 = conventional gelatin
fraction having a molecular weight of <100,000 = about 30%
gel strength = 150 g Bloom
viscosity (10%, 40° C.) = 33 mPas
hardening time (10%, 35° C.) = 250 minutes
Gelatin 2 = bone gelatin degraded by enzymatic action, "Gelatine ZKN 505" from Gelatinefabrik Koepff & Sohne, Heilbronn.
fraction having a molecular weight of <100,000 = 46.7%
gel strength = 235 g Bloom
viscosity (10%, 40° C.) = 11.4 mPas
hardening time (10%, 35° C.) = 360 minutes
Silicon dioxide = Syloid 244
Wetting agent = Triton × 100
IPA/BU/$H_2O$ = solvent mixture
isopropanol:butanol:water = 1:1:2
TAF/FA = mixture of hardening agents 1,3,5-triacryloyl-hexahydro-s-triazine:formaldehyde = 1:0.4

The anticurl layer solution was applied to the back of the base support material by using a roller and doctor application and was dried from the sol form in a hot air channel at an air temperature of 130° C. The machine speed was 120 m/min.

EXAMPLES B4–B6 AND COMPARATIVE EXAMPLE V4

The base support material from Example 1 was coated with the following anticurl layer solution using the same machine settings:

| | Concentration of the aqueous dilution, wt % | Amounts of Ingredients, wt % | | | | | |
|---|---|---|---|---|---|---|---|
| | | Example B4a | Example B4b | Example B4c | Example B5 | Example B6 | Comparative Example V4 |
| Gelatin 1 | 25 | — | — | — | — | — | 55.0 |
| Gelatin 2 | 30 | 45.0 | 45.0 | 45.0 | 55.0 | 42.5 | — |
| Sodium nitrate | 25 | 1.2 | 1.2 | 1.2 | 1.4 | 1.2 | 1.2 |
| Silicon dioxide | | 4.4 | 4.4 | 4.4 | — | 4.4 | 4.4 |
| Wetting agent, Saponin Q | 5 | 1.6 | 1.6 | 1.6 | 1.6 | 1.6 | 1.6 |
| IPA/BU/$H_2O$ | | 8.0 | 8.0 | 8.0 | 8.0 | 10.0 | 8.0 |
| Rice starch | | — | — | — | 5.6 | — | — |
| Tylose C300 | 2 | — | — | — | — | 6.0 | — |
| Polyglycol, mol wt 400 | 50 | — | — | — | 7.0 | — | — |
| TGIC,* | 2 | 24.2 | 24.2 | 24.2 | 13.4 | 32.0 | 24.2 |
| Glycerol | | 1.2 | 1.2 | 1.2 | — | 1.4 | 1.2 |
| Demineralized water | | 14.4 | 14.4 | 14.4 | 8.0 | 0.9 | 4.4 |
| pH adjusted to | | 5.5 | 6.7 | 8.2 | 6.7 | 6.4 | 6.7 |
| Viscosity, mPas | | | | | | | |
| immediate | | 52 | 54 | 53 | 96 | 63 | 130 |
| after 16 hours | | 58 | 65 | 98 | 100 | 68 | 146 |
| Weight of application (dry), g/m$^2$ | | 3.7 | 3.6 | 3.7 | 4.3 | 2.9 | 3.6 |

*Triglycidyl isocyanurate

Test Methods

Water Absorption

A test strip was immersed in distilled water at 22° C. for 10 minutes and then dried. The test strip was weighed before and after drying. The weight difference was calculated on the basis of the amount of gelatin in this test strip. The amount of gelatin was calculated from the formulation, the weight applied and the size of the test strip. The water absorption is expressed in grams of water per gram of gelatin.

Scratch Resistance

The sample to be tested was placed in hot water at 30° C. for one minute. The sample while still wet was placed under a rake-like testing device whose 6 individual prongs carry different weights up to a maximum of 100 g. The pulling rate should be 0.8 cm/sec. The tested sample was dried and the scratch tracks were stained with paper light blue to make them visible. The results are expressed as the number of visible scratch tracks (max. 6).

Photographic Fog

Commercial photographic paper was incubated for 5 days at 50° C. in contact with the specimen and then developed and fixed photographically together with a blank specimen treated in the same way. The fog was evaluated in comparison with the fog in the blank specimen. A grade of 1 indicates no difference and a grade of 5 indicates a very great change.

| Examples & Comparative Examples | Test Results: Water absorption, g water/g gelatin | | Scratch resistance, number of scratch tracks | | Photographic fog, grade |
|---|---|---|---|---|---|
| | immed. | after 4 weeks | immed. | after 2 weeks | |
| B1 | 2.4 | 2.1 | 5 | 3 | 3–4 |
| V1 | 2.7 | 2.4 | 6 | 4 | 3–4 |
| B2 | 2.4 | 2.0 | 4 | 0 | 3 |
| V2 | 2.8 | 2.2 | 4 | 1 | 3 |
| B3 | 2.2 | 1.2 | 1 | 0 | 1–2 |
| V3 | 3.1 | 1.7 | 3 | 0 | 1–2 |
| B4a | 2.4 | 0.9 | 6 | 0 | 1–2 |
| B4b | 2.7 | 0.9 | 6 | 0 | 1–2 |
| B4c | 2.8 | 0.9 | 6 | 0 | 1–2 |
| B5 | 2.3 | 0.9 | 6 | 0 | 1–2 |
| B6 | 2.2 | 0.8 | 6 | 1 | 2–3 |
| V4 | 2.3 | 1.6 | 5 | 1 | 2–3 |

SUMMARY

These test results reveal that the values for water absorption and scratch resistance can be improved by using the gelatin according to this invention.

Anticurl layers with a water absorption of less than 1 g of water per g of gelatin can be achieved in a wide pH range by using the gelatin according to this invention in combination with triglycidyl isocyanurate as the hardening agent with favorable theological properties of the coating solution.

We claim:

1. A support material for light sensitive materials comprising:

a base material having a front side which is adapted to receive the light sensitive materials, and a back side opposite the front side; and an anticurl layer on said back side of said base material, said anticurl layer consisting essentially of a hardening agent and a bone gelatin which has been degraded by enzymatic action, has a gel strength of about 200–250 g Bloom and contains more than about 40% low molecular fractions having a molecular weight of less than 100,000, and wherein said anticurl layer with said gelatin therein defines an exterior exposed surface on the back side of the support material.

2. The support material of claim 1, wherein a 10 wt % aqueous solution of said gelatin has a viscosity of about 10–20 mPas at 40° C. and a hardening time of about 300–400 minutes at 35° C.

3. The support material of claim 1, wherein a 10 wt % aqueous solution of said gelatin has a viscosity of about 10–20 mPas at 40° C. and a hardening time of about 300–400 minutes at 35° C.

4. The support material of claim 1, wherein said hardening agent is triglycidyl isocyanurate.

5. The support material of claim 4, wherein said hardening agent is present in an amount of about 0.5–12 wt % based on the amount of gelatin.

6. The support material of claim 5, wherein said amount is about 1–6 wt %.

7. The support material of claim 1, wherein said hardening agent is present in an amount of about 0.5–12 wt % based on the amount of gelatin.

8. The support material of claim 7, wherein said amount is about 1–6 wt %.

9. The support material of claim 4, wherein said anticurl layer has a water absorption capacity of less than about 1 gram of water per gram of gelatin after 10 minutes of exposure to distilled water at 22° C.

10. The support material of claim 5, wherein said anticurl layer has a water absorption capacity of less than about 1 gram of water per gram of gelatin after 10 minutes of exposure to distilled water at 22° C.

11. The support material of claim 1, wherein said anticurl layer also contains ingredients selected from the group consisting of wetting agents, plasticizers, matting agents, organic acids, antistatics, salts and rheological aids.

12. The support material of claim 1, wherein said anticurl layer includes an aliphatic polyalcohol plasticizer having a molecular weight of up to about 2000.

13. The support material of claim 12, wherein said aliphatic alcohol is selected from the group consisting of ethylene glycol, glycerol and polyglycol.

14. The support material of claim 12, wherein said aliphatic alcohol is present in an amount of up to about 50 wt % based on the amount of gelatin.

15. The support material of claim 14, wherein said amount is about 5–35 wt % based on the amount of gelatin.

16. The support material of claim 2, wherein said hardening agent is triglycidyl isocyanurate which is present in an amount of about 0.5–12 wt % based on the amount of gelatin; wherein said anticurl layer has a water absorption capacity of less than about 1 gram of water per gram of gelatin after 10 minutes of exposure to distilled water at 22° C. and includes an aliphatic polyalcohol plasticizer having a molecular weight of up to about 2000, and which plasticizer is present in an amount of up to about 50 wt % based on the amount of gelatin.

17. The support material of claim 16, wherein said anticurl layer also contains ingredients selected from the group consisting of wetting agents, plasticizers, matting agents, organic acids, antistatics, salts and rheological aids.

* * * * *

UNITED STATES PATENT AND TRADEMARK OFFICE

CERTIFICATE OF CORRECTION

PATENT NO. : 5,374,510

DATED : Dec. 20, 1994

INVENTOR(S) : Westfal et al.

It is certified that error appears in the above-indentified patent and that said Letters Patent is hereby corrected as shown below:

Col. 3, line 30, delete "theological" and insert --rheological--.

Col. 7, line 29, delete "theological" and insert --rheological--.

Signed and Sealed this

Sixth Day of February, 1996

*Attest:*

Bruce Lehman

BRUCE LEHMAN

*Attesting Officer*

*Commissioner of Patents and Trademarks*